US009320663B2

(12) United States Patent
Poulos et al.

(10) Patent No.: US 9,320,663 B2
(45) Date of Patent: Apr. 26, 2016

(54) BED GAP FILLER

(75) Inventors: Craig Poulos, Wilmette, IL (US); Joseph Immordino, Hoffman Estates, IL (US); Patrick Harris, Downers Grove, IL (US)

(73) Assignee: Kreg Medical, Inc., Chicago, IL (US)

( * ) Notice: Subject to any disclaimer, the term of this patent is extended or adjusted under 35 U.S.C. 154(b) by 994 days.

(21) Appl. No.: 12/889,027

(22) Filed: Sep. 23, 2010

(65) Prior Publication Data

US 2011/0232001 A1 Sep. 29, 2011

Related U.S. Application Data

(63) Continuation-in-part of application No. 12/459,207, filed on Jun. 26, 2009.

(60) Provisional application No. 61/277,301, filed on Sep. 23, 2009, provisional application No. 61/133,267, filed on Jun. 27, 2008.

(51) Int. Cl.

| | |
|---|---|
| ***A47C 31/00*** | (2006.01) |
| ***A61G 7/015*** | (2006.01) |
| ***A61G 7/05*** | (2006.01) |
| ***A61G 7/16*** | (2006.01) |

(52) U.S. Cl.

CPC *A61G 7/015* (2013.01); *A61G 7/05* (2013.01); *A61G 7/16* (2013.01)

(58) Field of Classification Search

CPC ..... A47C 19/04
USPC ..... 5/424, 425, 658, 181, 185, 661, 663, 5/600, 251

See application file for complete search history.

(56) References Cited

U.S. PATENT DOCUMENTS

| | | | | | |
|---|---|---|---|---|---|
| 2,956,290 | A | * | 10/1960 | Scheinerman | 5/308 |
| 3,646,621 | A | * | 3/1972 | Fragas | 5/617 |
| 4,370,765 | A | | 2/1983 | Webber | |
| 4,613,182 | A | | 9/1986 | Stone | |
| 4,672,698 | A | | 6/1987 | Sands | |
| 4,899,404 | A | * | 2/1990 | Galumbeck | 5/616 |
| 4,918,829 | A | | 4/1990 | Harris | |
| 5,077,843 | A | | 1/1992 | Foster et al. | |
| 5,083,332 | A | | 1/1992 | Foster et al. | |
| 5,084,925 | A | | 2/1992 | Cook | |
| 5,179,744 | A | | 1/1993 | Foster et al. | |
| 5,214,809 | A | | 6/1993 | Stuart | |
| 5,331,698 | A | * | 7/1994 | Newkirk et al. | 5/602 |
| 5,377,370 | A | | 1/1995 | Foster et al. | |
| 5,481,772 | A | | 1/1996 | Glynn et al. | |
| 5,485,699 | A | | 1/1996 | Gabhart | |
| 5,732,423 | A | | 3/1998 | Weismiller et al. | |
| 5,745,936 | A | | 5/1998 | Van McCutchen et al. | |
| 5,749,112 | A | | 5/1998 | Metzler | |
| 5,784,732 | A | | 7/1998 | Vail | |
| 5,878,452 | A | | 3/1999 | Brooke et al. | |
| 6,038,721 | A | | 3/2000 | Gordon | |

(Continued)

*Primary Examiner* — David E Sosnowski
(74) *Attorney, Agent, or Firm* — McDermott Will & Emery LLP

(57) ABSTRACT

A gap filler assembly for filling a gap between adjacent sections of a bed. The gap filler assembly has a mattress portion that has an extension at one end thereof that extends between a gap between a first section of the bed and an adjacent second section of the bed. The mattress portion may be a supplemental mattress that is adjacent a side of a main mattress. The mattress portion may also have a hinged slider component on a bottom surface thereof.

10 Claims, 9 Drawing Sheets

(56) References Cited

U.S. PATENT DOCUMENTS

| | | | | |
|---|---|---|---|---|
| 6,112,345 | A | 9/2000 | Foster et al. | |
| 6,256,822 | B1 | 7/2001 | Weston et al. | |
| 6,347,422 | B2 | 2/2002 | Heavrin | |
| 6,357,065 | B1 * | 3/2002 | Adams | 5/618 |
| 6,360,385 | B1 | 3/2002 | Lewandowski | |
| 6,363,552 | B1 | 4/2002 | Hornbach et al. | |
| 6,374,437 | B1 | 4/2002 | Voelker | |
| 6,401,277 | B1 | 6/2002 | Savage et al. | |
| 6,427,264 | B1 | 8/2002 | Metz et al. | |
| 6,446,283 | B1 | 9/2002 | Heimbrock et al. | |
| 6,460,930 | B2 | 10/2002 | Thornton | |
| 6,622,323 | B2 | 9/2003 | Zerhusen et al. | |
| 6,622,364 | B2 | 9/2003 | Hamilton et al. | |
| 6,640,360 | B2 | 11/2003 | Hornbach et al. | |
| 6,640,361 | B2 | 11/2003 | Heimbrock et al. | |
| 6,678,908 | B2 | 1/2004 | Borders et al. | |
| 6,684,436 | B1 * | 2/2004 | Lovelace | 5/722 |
| 6,694,557 | B1 | 2/2004 | Bobey et al. | |
| 6,704,954 | B2 | 3/2004 | Metz et al. | |
| 6,721,975 | B1 | 4/2004 | Lemire | |
| 6,728,985 | B2 | 5/2004 | Brooke et al. | |
| 6,779,209 | B2 | 8/2004 | Ganance | |
| 6,799,340 | B2 | 10/2004 | Schatz | |
| 6,820,293 | B2 | 11/2004 | Alverson | |
| 6,829,793 | B2 | 12/2004 | Brooke et al. | |
| 6,829,796 | B2 | 12/2004 | Salvatini et al. | |
| 6,874,179 | B2 | 4/2005 | Hensley et al. | |
| 6,928,673 | B2 | 8/2005 | Risk, Jr. | |
| 6,951,036 | B2 | 10/2005 | Lemire | |
| 6,952,846 | B2 | 10/2005 | Flannery et al. | |
| 7,007,323 | B2 | 3/2006 | Zerhusen et al. | |
| 7,028,352 | B2 | 4/2006 | Kramer et al. | |
| 7,028,358 | B2 | 4/2006 | Liu | |
| 7,107,636 | B2 | 9/2006 | Metz et al. | |
| 7,107,637 | B2 | 9/2006 | Kuek et al. | |
| 7,412,734 | B2 | 8/2008 | Stryker et al. | |
| 7,698,761 | B2 * | 4/2010 | Neuenswander et al. | 5/618 |
| 7,779,494 | B2 * | 8/2010 | Poulos et al. | 5/618 |
| 8,069,514 | B2 * | 12/2011 | Poulos et al. | 5/618 |
| 8,539,625 | B2 * | 9/2013 | Poulos et al. | 5/658 |
| 2002/0078509 | A1 * | 6/2002 | Williams | 5/716 |
| 2006/0021142 | A1 * | 2/2006 | Hornbach | A47C 19/045 5/600 |
| 2006/0026762 | A1 * | 2/2006 | Hornbach | A47C 19/045 5/611 |
| 2006/0053555 | A1 * | 3/2006 | Poulos | A61G 7/005 5/618 |
| 2006/0059621 | A1 * | 3/2006 | Poulos | A61G 7/005 5/430 |
| 2006/0195986 | A1 * | 9/2006 | Hakamiun et al. | 5/600 |
| 2010/0005592 | A1 * | 1/2010 | Poulos et al. | 5/618 |

* cited by examiner

BED GAP FILLER

CROSS-REFERENCE TO RELATED APPLICATIONS

This application is a continuation-in-part of U.S. patent application No. 12/459,207, filed on Jun. 26, 2009, which claims priority from U.S. Provisional Patent Application No. 61/133,267, filed on Jun. 27, 2008. This application also claims priority from U.S. Provisional Patent Application No. 61/277,301, filed on Sep. 23, 2009, which is expressly incorporated herein by reference and made a part thereof.

FEDERALLY SPONSORED RESEARCH OR DEVELOPMENT

Not Applicable.

TECHNICAL FIELD

The present invention relates generally to a gap filler, and more specifically to a gap filler between mattress sections of a bed, including an expandable width bed.

BACKGROUND OF THE INVENTION

Hospital beds are well known in the art. One type of hospital bed is an articulating bed. Another type of hospital bed is an expandable width bed. Expandable width beds generally include an expandable frame and supplemental mattress sections therewith. While such articulating and expandable width beds according to the prior art provide a number of advantageous features, they nevertheless often have certain limitations, including possibly having undesirable gaps between various sections of the mattress and/or between various supplemental mattress sections. Such undesirable gaps may be present in standard hospital beds as well. The present invention seeks to overcome certain of these limitations and other drawbacks of the prior art, and to provide new features not heretofore available. A full discussion of the features and advantages of the present invention is deferred to the following detailed description, which proceeds with reference to the accompanying drawings.

SUMMARY OF THE INVENTION

The present invention generally provides a gap filler assembly for filling a gap between adjacent mattress sections of a bed. According to one embodiment the gap filler comprises a deck plate, a hinge connected to the deck plate, a backing member connected to the hinge and opposing the deck plate, a slider connected to the backing member, and a first mattress component supported by the deck plate, wherein the first mattress component has an angled surface on a bottom portion thereof adjacent the slider.

According to another embodiment, the gap filler assembly further comprising a second gap filler opposing the first gap filler, the second gap filler comprising a deck plate, a hinge connected to the deck plate, a backing member connected to the hinge and opposing the deck plate, a slider connected to the backing member, and a second mattress component supported by the deck plate, wherein the second mattress component has an angled surface on a bottom portion thereof adjacent the slider.

According to another embodiment, the first gap filler assembly is adjacent a head section of the bed and the second gap filler assembly is adjacent a seat section of the bed. In this embodiment the first mattress opposes and contacts the second mattress when the bed is in a horizontal position to fill a gap between the head section of the bed and the seat section of the bed.

According to another embodiment, the first gap filler assembly is connected to a first section of the bed and the first mattress component extends beyond a midline between the first section of the bed and an adjacent second section of the bed. The second gap filler assembly is connected to the second section of the bed and the second mattress component extends beyond a midline between the first section of the bed and the second section of the bed. In this embodiment an interference is established between the first and second mattress components when the first and second sections of the bed are in a horizontal position.

According to another embodiment, the gap filler assembly comprises a first supplemental mattress connected to a first section of the bed adjacent a first side of the main mattress. The first supplemental mattress has a patient support surface generally planar with a patient support surface of the main mattress to increase a width of the patient support surface of the bed. The first supplemental mattress has an extension at one end thereof that extends between a gap between the first section of the bed and an adjacent second section of the bed. Additionally, the first supplemental mattress may extend beyond a midline between the first section of the bed and an adjacent second section of the bed.

According to another embodiment, the gap filler assembly further comprises a second supplemental mattress connected to a second section of the bed adjacent the first side of the main mattress. The second supplemental mattress has a patient support surface generally planar with the patient support surface of the main mattress to increase a width of the patient support surface of the bed. The second supplemental mattress has an extension at one end thereof that extends between a gap between the first section of the bed and the second section of the bed. Additionally, the second supplemental mattress extends beyond a midline between the first section of the bed and the second section of the bed.

According to another embodiment, the first supplemental mattress is connected to a hinge assembly and comprises a deck plate, a hinge connected to the deck plate, a backing member connected to the hinge and opposing the deck plate, and a slider connected to the backing member, and the first supplemental mattress has an angled surface on a bottom portion thereof adjacent the slider.

According to another embodiment, the first supplemental mattress has an angled surface on a bottom portion thereof toward a top surface of the supplemental mattress. Additionally, the slider may be connected to the supplemental mattress adjacent the angled bottom surface of the first supplemental mattress.

According to another embodiment, the gap filler assembly comprises a first supplemental mattress connected to supplemental mattress frame that adjusts between a narrow retracted position and an expanded position. The first supplemental mattress is positioned adjacent a first side of the main mattress in the expanded position. The first supplemental mattress has a patient support surface generally planar with a patient support surface of the main mattress to increase a width of the patient support surface of the bed, and the first supplemental mattress has an extension at one end thereof that extends outside the supplemental mattress frame.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
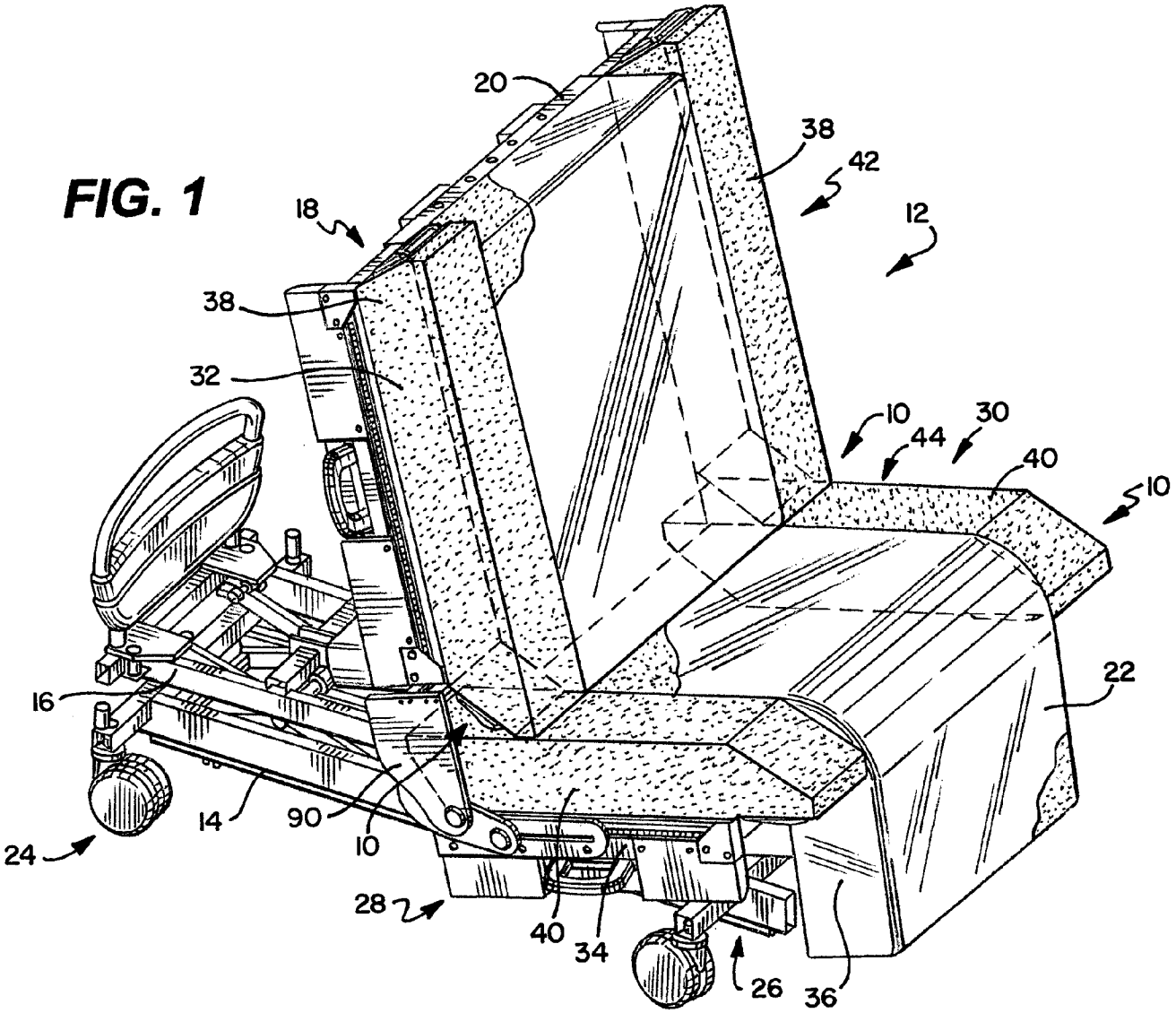
FIG. 1 is a perspective view of one embodiment of a hospital bed with the head section in an upward position, and having supplemental mattresses with gap fillers provided between various sections of the bed.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to the Figures, there are shown various embodiments of a gap filler assembly 10 for a hospital bed 12. The term "bed" herein is used to denote any embodiment of a support for a patient. As such, in different embodiments the "bed" may be provided as a standard hospital bed, an articulating bed, a chair bed, an expandable width bed, a stretcher, a gurney or some other patient support or combination thereof. For example, in the chair bed configuration the bed is manipulated to achieve both a conventional bed position having a substantially horizontal patient support or sleeping surface upon which a user lies in a supine position, and a sitting position wherein the user's feet are on or adjacent the floor and the back of the user is supported by a raised back support. Similarly, as another example, in the expanding width bed configuration the bed is manipulated to convert to a wider patient support surface at various portions of the bed. The width of the expanding width bed 12 may be narrowed, however, to that of a conventional hospital bed to provide for ease of mobility of the bed 12. Additionally, in another embodiment the bed 12 is a bariatric bed, meaning it is provided to support morbidly obese patients.

The bed 12 generally comprises a base assembly 14, an intermediate frame assembly 16, and a patient support assembly 18. The patient support assembly 18 preferably comprises a support deck assembly 20 and a mattress 22, however, either component individually or both collectively may be identified as the patient support. In one embodiment at least a portion of the support deck assembly 20 extends from and is connected to the intermediate frame assembly 16. The patient support assembly 18 may also include a patient support extension assembly, also referred to as a deck or mattress extension assembly. The mattress 22 may be a foam mattress, inflatable mattress, fluidized mattress, percussion mattress, rotation mattress or any other type of mattress known in the art. As explained above, in one embodiment the bed 12 will be capable of transitioning to a chair orientation and to an expanded width orientation.

The bed 12 preferably has a head end 24, a foot end 26 opposing the head end 24, a first side 28, and a second side 30 opposing the first side 28. The term "head end" is used to denote the end of any referred to object that is positioned to lie nearest the head end 24 of the bed 12, and the term "foot end" is used to denote the end of any referred to object that is positioned to lie nearest the foot end 26 of the bed 12.

Additionally, in a preferred embodiment the bed 12 has a plurality of different sections, which may be articuable sections. For example, in the embodiment illustrated, the bed 12 has a head section 32, a seat section 34 and a foot section 36. The head section 32 may also be referred to as a first section, the seat section 34 may also be referred to as a second section, and the foot section 36 may also be referred to as a third section. The seat section 34 is positioned between the head section 32 and the foot section 36. In various embodiments of the bed, the head section 32 is generally moveable from a generally horizontal position to a more vertical back-support position. Similarly, in various embodiments of the bed 12, such as a chair bed as shown in FIG. 1, the foot section 36 is moveable from a generally horizontal position to a substantially vertical position.

In a preferred embodiment, the bed 12 can assume a plurality of positions/orientations via manipulation of the intermediate frame assembly 16 and the various sections of the bed 12. Further, as detailed herein, in different embodiments the mattress 22 can also attain a variety of positions/orientations.

As examples of the different orientations that can be attained, the bed 12 can assume a standard bed position such that the support deck assembly 20 is in the horizontal position, the bed 12 can assume a chair orientation such as shown in FIG. 1, and the bed 12 can assume a variety of positions therebetween. Additionally, the intermediate frame assembly 16 can be independently raised and lowered at the head end 24 and foot end 26 of the bed 12. As such, when the foot end 26 of the intermediate frame assembly 16 is raised and the head end 24 is maintained in a lowered position the bed 12 can assume the Trendelenburg position, and conversely when the head end 24 of the intermediate frame assembly 16 is raised and the foot end 26 is maintained in a lowered position the bed 12 can assume the reverse Trendelenburg position. Further, the entire intermediate frame assembly 16 can be raised simultaneously to assume a raised bed orientation, and the entire intermediate frame assembly 16 can be lowered simultaneously to assume a lowered bed orientation or a lowered chair bed orientation.

Figure 15:
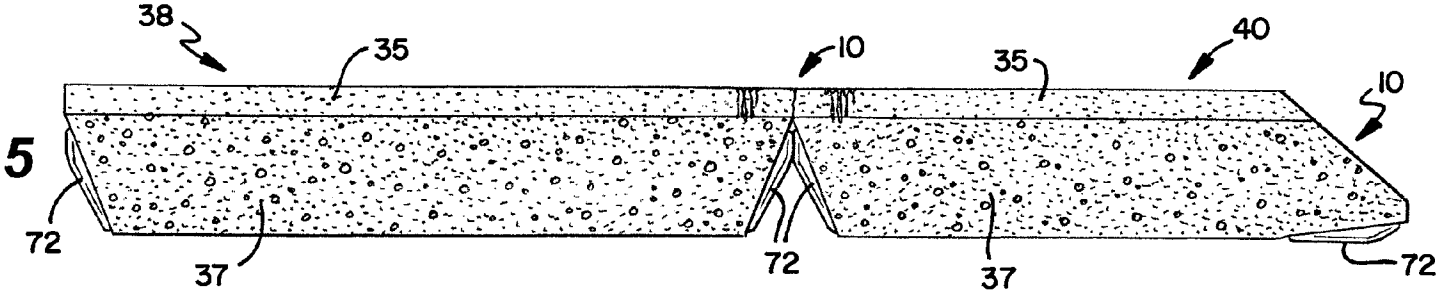
FIG. 15 is a side view of another embodiment of the gap filler assembly wherein the supplemental mattresses comprise a first lower component and a second upper component.

In one embodiment of the bed 12 wherein the bed 12 has a variable width component, the bed 12 may have supplemental mattresses 38, 40 that are used to increase the width of the mattress 22 for the bed 12. In one embodiment first supplemental mattresses 38 are provided at the first side 28 and second side 30 of the head section 32 of the bed 12, and second supplemental mattresses 40 are provided at the first side 28 and second side 30 of the seat section 34 of the bed 12. In a preferred embodiment the supplemental mattresses 38, 40 are connected to the bed 12 in the expanded and the retracted positions. Preferably, the supplemental mattresses 38, 40 are made of foam, however, it is understood that they may be made of other materials or configurations, including air/inflatable configurations and fluidized configurations. Additionally, in one embodiment shown in FIG. 15, the supplemental mattresses 38, 40 have an upper layer 35 that is different to the lower layer 37. In one version of this embodiment the upper layer may be a foam that is different in ILD to the lower layer, such that the upper layer is softer than the lower layer. Alternately, the upper layer may be made of a different material or construction type, e.g., an air bladder, than the lower layer.

In one embodiment the supplemental mattresses 38, 40 are supported by one or more of a variety of patient support extension assemblies, which may include mattress or deck extender assemblies, hereinafter referred to as mattress extender assemblies. As with the supplemental mattresses, the mattress extender assemblies may be provided at one or more sections of the bed 12. Additionally, mattress extender assemblies may be provided at each side of any section of the bed 12. In one embodiment, a first head mattress extender assembly 42 for one of the head section supplemental mattresses 38 is provided at the first side 28 of the head section 32 of the bed 12, and a second head mattress extender assembly 42 for the other head section supplemental mattress 38 is provided at the opposing second side 30 of the head section 32 of the bed 12. Similarly, in one embodiment, a first seat mattress extender assembly 44 for one of the seat supplemental mattresses 40 is provided at the first side 28 of the seat section 34 of the bed 12, and a second seat mattress extender assembly 44 for the other seat supplemental mattress 40 is provided at the opposing second side 30 of the seat section 34 of the bed 12. The head and seat first side mattress extender assemblies 42, 44 are utilized to increase the width of the bed 12 at the first side 28 of the bed 10, and the head and seat second side mattress extender assemblies 42, 44 are utilized to increase the width of the bed 12 at the second side 30 of the bed 12. Generally, the supplemental mattresses 38, 40 are connected to supplemental deck plates 39 that are then connected to the appropriate mattress extender assembly 42, 44.

In a preferred embodiment, the head mattress extender assemblies 42 are movably connected to the head section 32 of the bed 12 and allowed to move relative thereto, and the seat mattress extender assemblies 44 are movably connected to the seat section 34 of the bed 12 and allowed to move relative thereto. Generally, the head and seat mattress extender assemblies 42, 44 are each independently moveable from a first retracted position located a first distance from a centerline of the bed 12 to a second expanded position located a second distance from the centerline of the bed 12, the second distance being greater than the first distance. As explained above, a first supplemental mattress 38 is connected to the first mattress extender section 42 in the first and second position, preferably through the supplemental deck plate 39, and a second supplemental mattress 40 is connected to the second mattress extender section 44 in the first and second position, also preferably through the supplemental deck plate 39. Thus, in a preferred embodiment the supplemental mattresses are connected to the bed 12 in all positions and are not needed to be removed from the bed 12 when the bed is transitioned to the narrow configuration.

As explained above, the mattress extender assemblies 42, 44 each move from a first retracted position to a second expanded position. Moreover, in a preferred embodiment, the mattress extender assemblies 42, 44 slidably engage the main deck to move from the first retracted position to the second expanded position. Additionally, in a preferred embodiment the supplemental mattresses 38, 40 are positioned underneath the main deck in a first position, and adjacent the main mattress 22 in a second position. The supplemental mattress 38, 40 increases the width of a surface supporting a patient in the second position.

Figure 10:
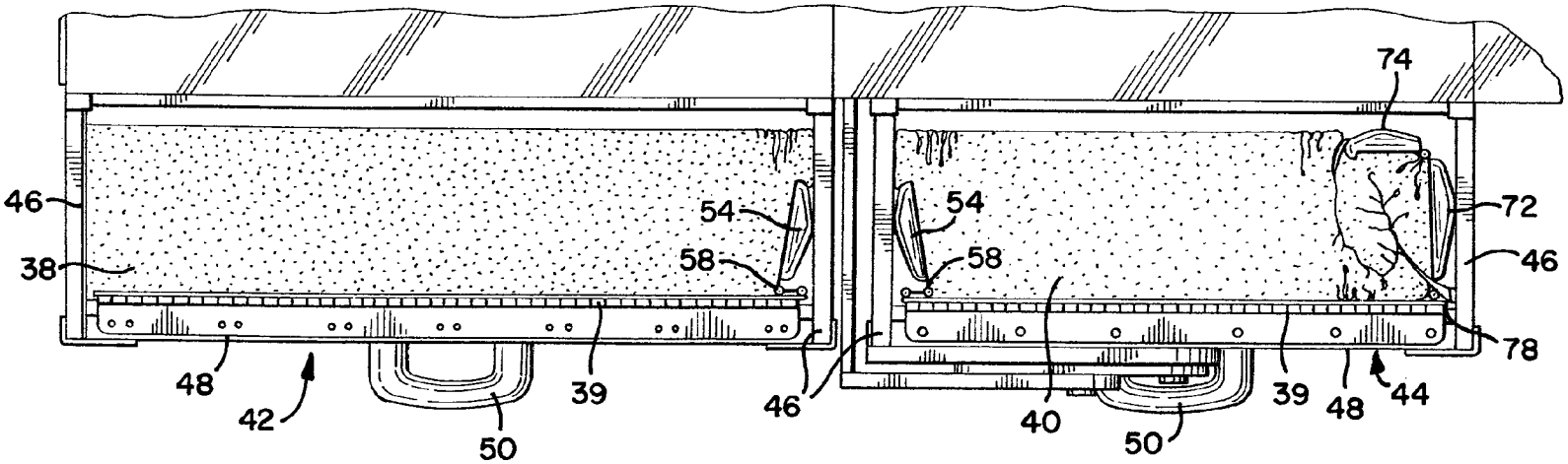
FIG. 10 is a partial top view of the hospital bed of FIG. 2 having mattress extenders with supplemental mattresses having gap fillers, and wherein the supplemental mattresses are provided in the retracted or non-deployed position.
Figure 12:
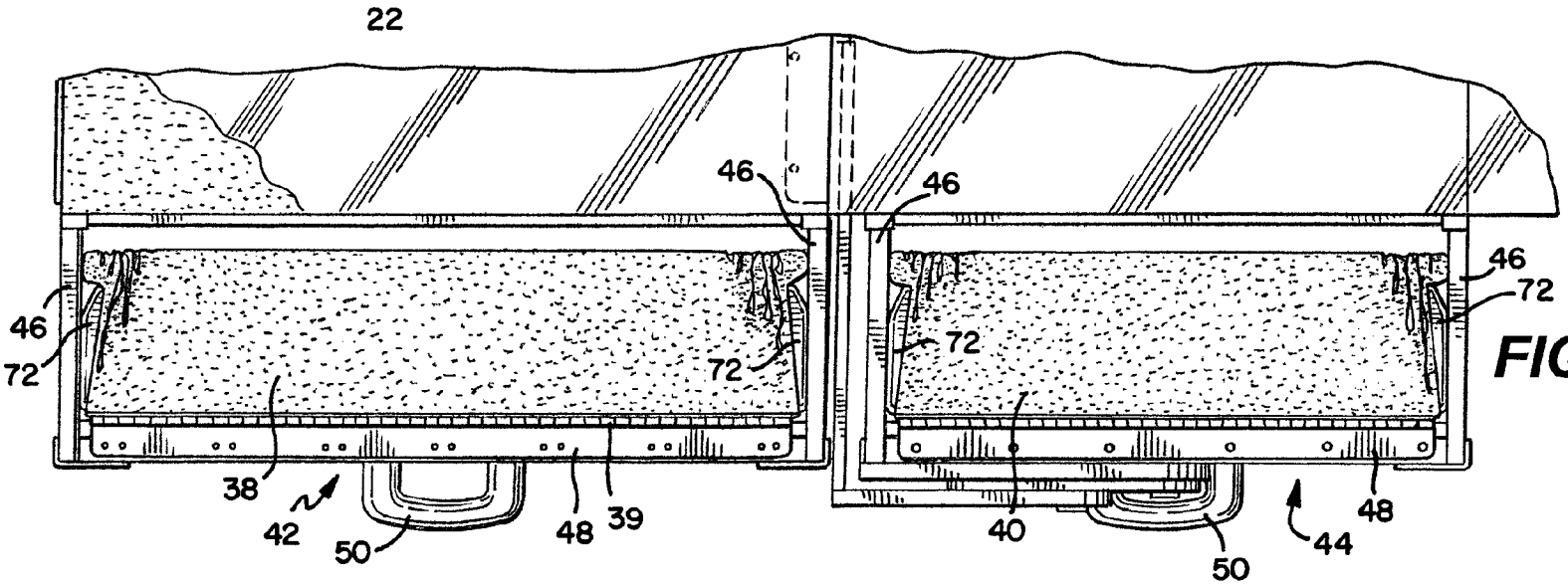
FIG. 12 is a partial top view of the embodiment of a hospital bed of FIG. 11 having mattress extenders with supplemental mattresses having gap fillers, and wherein the supplemental mattress are provided in the closed or non-deployed position.

In one embodiment, as shown in FIGS. 10 and 12, the mattress extender assemblies 42, 44 each generally comprise a first and second side rail 46, and an endplate 48 connecting the side rails 46. Additionally, a handle 50 is preferably connected to the endplate 48. The handle 50 is utilized to open and close the mattress extender assemblies 42, 44.

Accordingly, in a preferred embodiment, the mattress extender assemblies 42, 44 each have independent supplemental mattresses 38, 40, respectively, associated therewith. Preferably, the first and second side head and seat mattress extender assemblies 42, 44 are each independently moveable from a first retracted position to a second expanded position. In one embodiment the distance from the centerline of the bed 12 to an edge of the mattress 22 is identified as distance $W_1$, and the distance from the centerline of the bed 12 to an edge of either of the supplemental mattresses 38, 40 after the supplemental mattress 38, 40 has been repositioned to be in the expanded position is identified as distance $W_2$, and $W_2$ is greater than $W_1$. In a preferred embodiment, the width of the supplemental mattress 38, 40 is approximately 5 inches, and thus the distance from $W_1$ to $W_2$ is approximately 5 inches. Thus, in a preferred embodiment the width of the supplemental mattress 38, 40 is adapted to increase the width of the mattress 22 of the bed 12 approximately 5 inches per side, for a total mattress width increase of 10 inches. In a preferred embodiment, the supplemental mattresses 38, 40 are movably connected to the mattress extender assemblies 42, 44 in both the retracted positions and the extended positions. And, in a preferred embodiment, the supplemental mattresses 38, 40 are independently rotatably connected to the mattress extender assemblies 42, 44 in both the retracted positions and the extended positions. It is further understood that in a preferred embodiment, the supplemental mattresses 38, 40 are connected to the bed 12 in both the first position and the second position.

In a preferred embodiment, each of the mattress extender assemblies 42, 44 operate completely independently. Accordingly, any mattress extender assembly 42, 44 of the bed 12 may be in the retracted or non-deployed position, or the expanded or deployed position at any time, irrespective of any other mattress extender assembly 42, 44.

Figure 14:
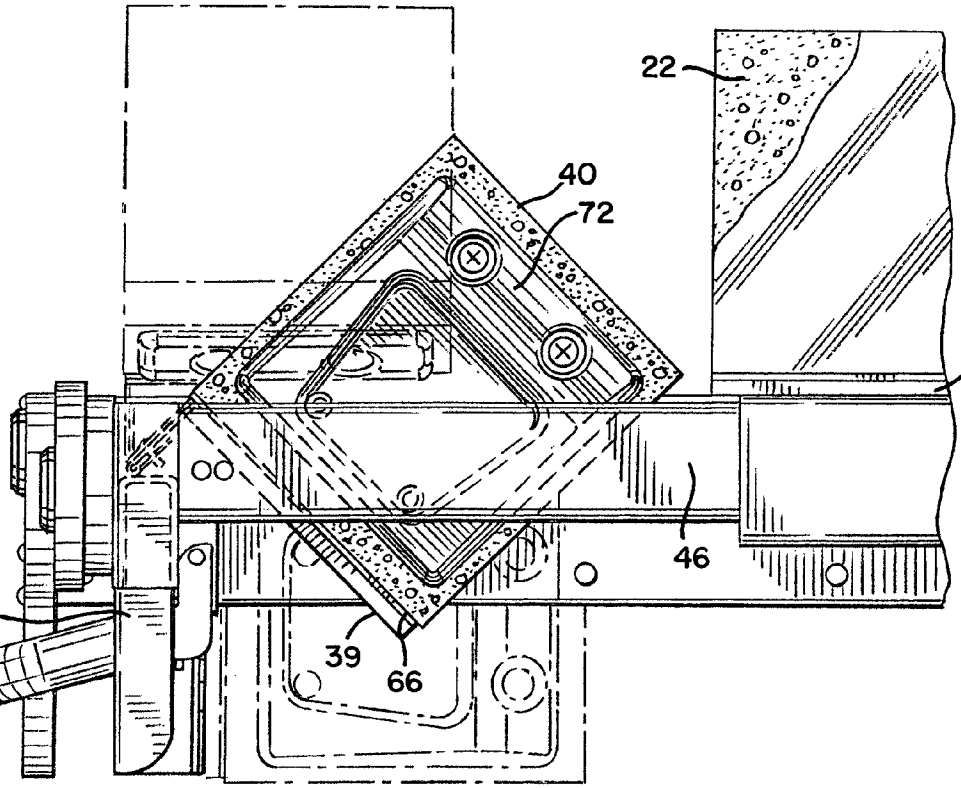
FIG. 14 is a partial end view taken from lines 14-14 in FIG. 11, illustrating the supplemental mattress at the seat section of this embodiment being transitioned from the expanded or deployed position to the retracted or non-deployed position within the mattress extender assembly.

According to another embodiment, the supplemental mattresses 38, 40 are rotatably connected to the mattress extenders 42, 44. In such an embodiment, the supplemental mattresses 38, 40 are connected to the supplemental deck plates 39, which are rotatably connected to the appropriate mattress extender assembly 42, 44. Additionally, in one embodiment the supplemental mattresses 38, 40 are moveable from a first position, wherein a portion of the supplemental mattresses 38, 40 are under a plane of the main deck, to a second position wherein a portion of the supplemental mattresses 38, 40 are over the plane of the main deck. This is shown in FIG. 14, where in the first non-deployed position the supplemental mattress 38, 40 is positioned underneath the deck plate 21. And, since in this preferred embodiment the supplemental mattress 38, 40 is rotatable as shown in FIG. 14, the supplemental mattress 38, 40 can be rotated to the deployed position such that the top surface of the supplemental mattress 38, 40 is generally co-planar with the main mattress 22. After the mattress extender assembly 42, 44 is properly positioned the supplemental mattress 38, 40 will be positioned adjacent the main mattress 22 as shown in FIG. 1.

As explained above, referring to FIGS. 2, 9, 11 and 13, the bed 12 may also have a gap filler assembly 10. The gap filler assembly 10 is generally utilized with an expandable width bed, however, the technology is applicable on a variety of other types of beds, including standard hospital beds, articulating beds, chair beds, etc. The gap filler assembly 10 operates to provide a mattress filler between the adjacent mattress sections, including supplemental mattress sections, such that the edge of the mattress will be generally continuous in support in the widened areas.

Figure 2:
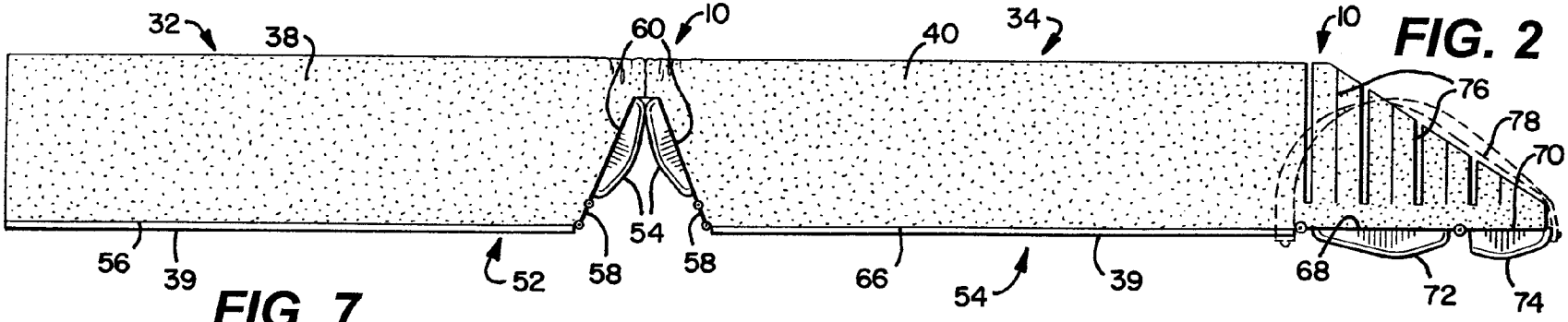
FIG. 2 is a partial side view of one embodiment of a hospital bed with mattress extenders having supplemental mattresses shown in the up or deployed/actuated position, and having gap fillers on the supplemental mattresses.
Figure 8:
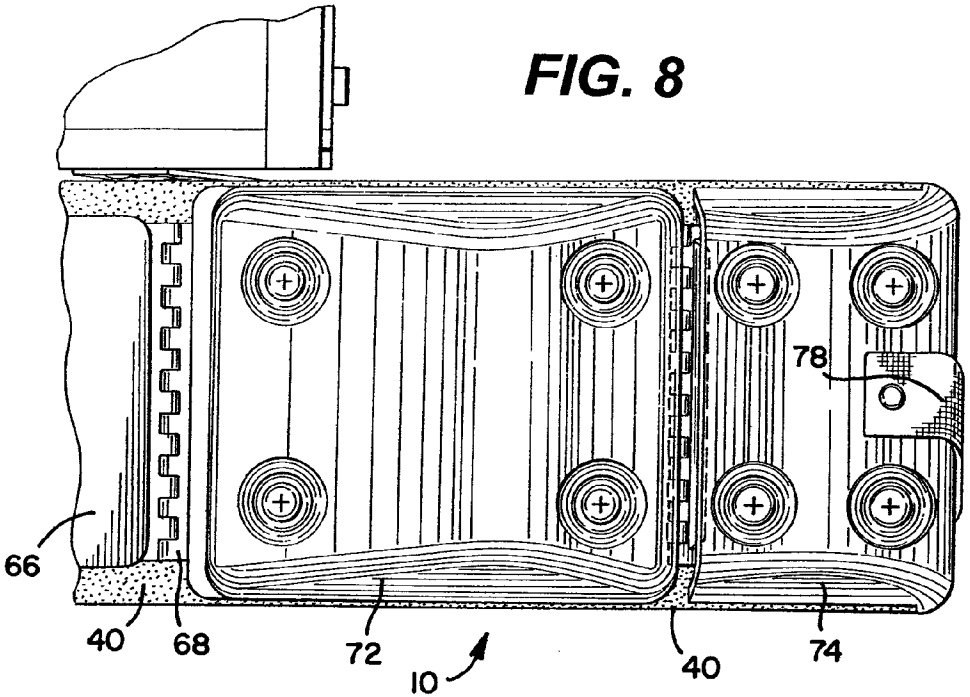
FIG. 8 is a partial end view of one embodiment of the gap filler assembly at the foot end of the seat section supplemental mattress of FIG. 2.
Figure 3:
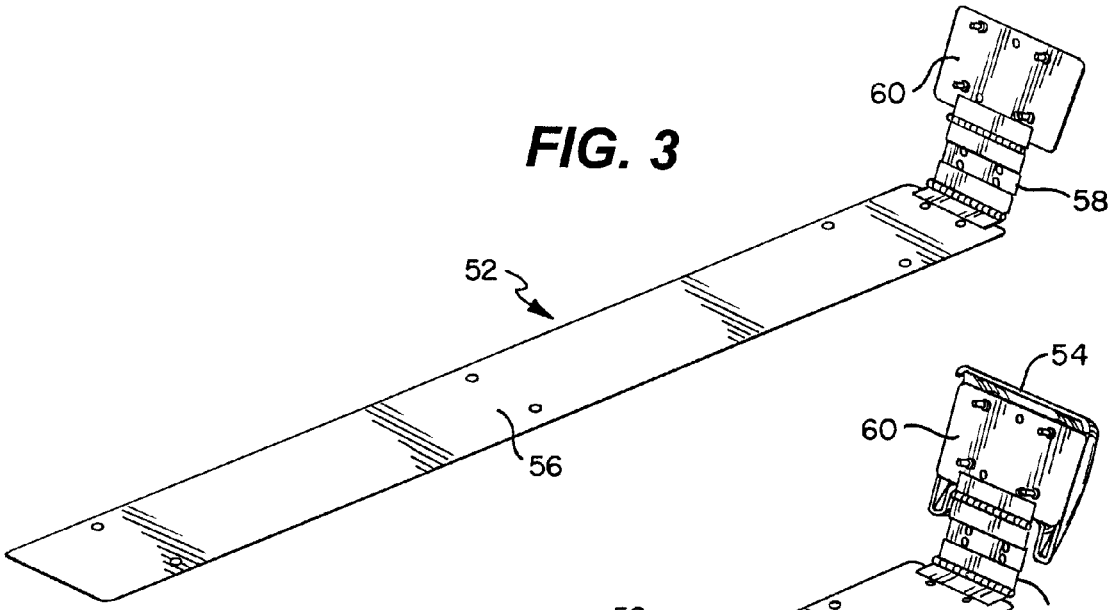
FIG. 3 is a perspective view of one embodiment of a hinge assembly for the head section supplemental mattress gap filler assembly of FIG. 2.

In one embodiment, as shown in FIGS. 2-10, a gap filler assembly 10 is provided at the head section 32 and the seat section 34. The gap filler assembly 10 at the head section 32 generally comprises the supplemental mattress 38, a hinge assembly 52, and a cap member 54. Referring to FIG. 3, the hinge assembly 52 generally comprises a deck plate 56, a double hinge member 58, and a backing member 60. In a preferred embodiment the deck plate 56 is fixedly connected at its foot end 26 to the double hinge member 58, preferably by welding, and the double hinge member 58 is fixedly connected to the backing member 60, also preferably by welding such as spot welding. The supplemental mattress 38 is connected, such as with an adhesive, to the deck plate 56, double hinge member 58 and backing member 60. The deck plate 56 is subsequently connected to the supplemental deck plate 39 of the head mattress extender assembly 42. In one embodiment the deck plate 56 has internal receivers, such as PEM® nuts, to allow the deck plate 56 to be secured, such as by bolting, to the supplemental deck plate 39. Once the supplemental mattress 38 is connected to the supplemental deck plate 39 it can be manipulated between the deployed and non-deployed positions in the mattress extender assembly 42.

Figure 7:
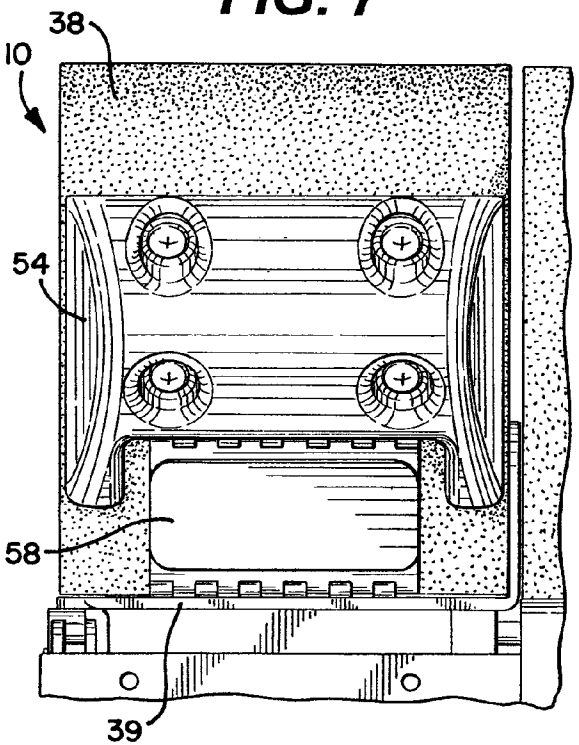
FIG. 7 is a partial end view of one embodiment of the gap filler assembly at the foot end of the head section supplemental mattress and the head end of the seat section supplemental mattress of FIG. 2.
Figure 4:
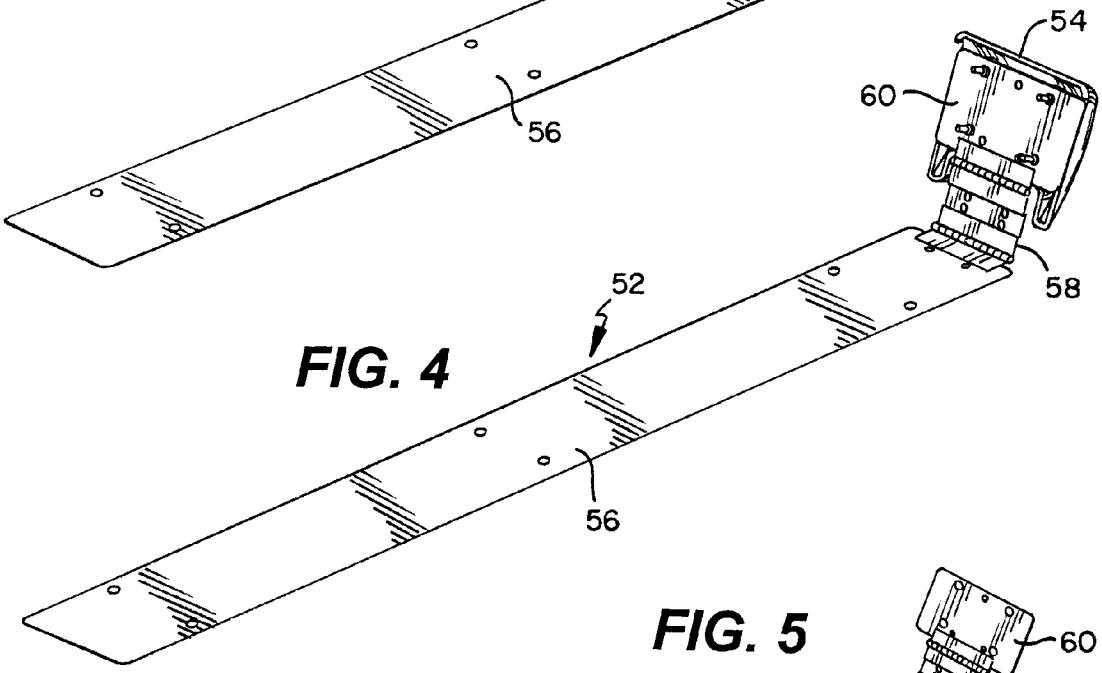
FIG. 4 is a perspective view of one embodiment of a gap filler assembly for the head section supplemental mattress of FIG. 2.

In one embodiment the cap member 54 is secured to the hinge assembly 52 as shown in FIGS. 2, 4 and 7. As with the deck plate 56, in a preferred embodiment the backing member or backing plate 60 also has internal receivers to allow the cap member 54 to be bolted to the backing plate 60.

As shown in the side view of FIG. 2, in one embodiment the head end 24 of the head section supplemental mattress 38 is generally flat, or in a plane perpendicular to the top surface of the supplemental mattress 38. Conversely, a portion of the foot end 26 of the head section supplemental mattress 38 is preferably angled, or in a plane tangential to the top surface of the supplemental mattress 38. This allows the top surface of the head section supplemental mattress 38 to extend further toward the foot end 26 of the bed 12, including extending beyond the side rail 46 of the head mattress extender assembly 42. Additionally, as shown in FIG. 2, in a preferred embodiment a top portion of the supplemental mattress 38 above the cap member 54 also extends toward the foot end 26 of the bed 12 even further than the cap member 54 to essentially cover the top surface of the cap member 54.

Referring again to FIG. 2, a portion of the seat section 34 gap filler assembly 10 is similar to the head section 32 gap filler assembly 10, and another portion of the seat section 34 gap filler assembly 10 is distinct from the head section 32 gap filler assembly 10. Specifically, the head end 24 portion of the seat section 34 gap filler assembly 10 is generally a mirror image of the foot end 26 portion of the head section 32 gap filler assembly 10 described above. However, the foot end 26 portion of the seat section 34 gap filler assembly 10 is distinct from the head section 32 gap filler assembly 10.

Figure 5:
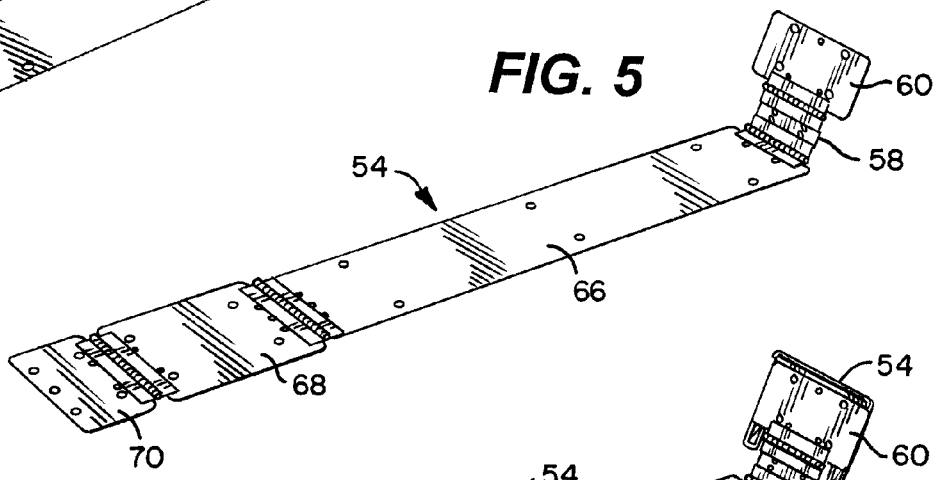
FIG. 5 is a perspective view of one embodiment of a hinge assembly for the seat section supplemental mattress gap filler assembly of FIG. 2.
Figure 6:
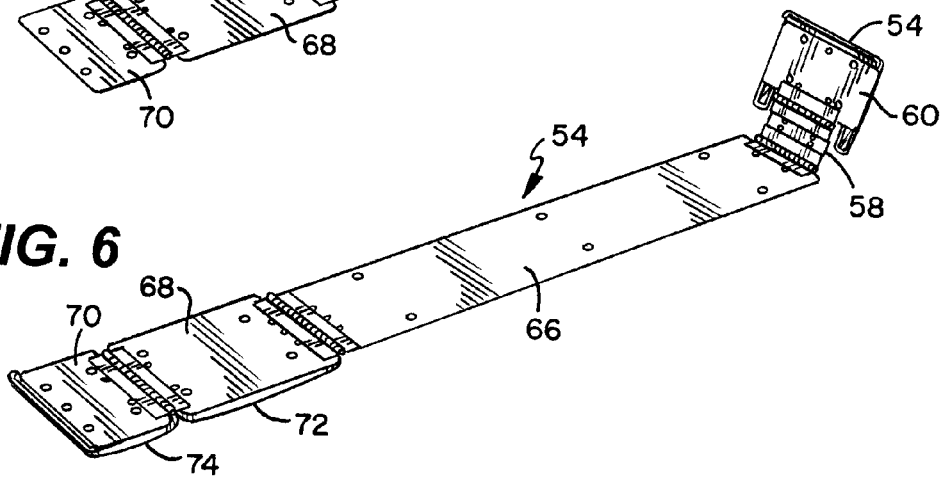
FIG. 6 is a perspective view of one embodiment of a gap filler assembly for the seat section supplemental mattress of FIG. 2.

Referring to FIGS. 2 and 5-8, in one embodiment the gap filler assembly 10 at the seat section 34 generally comprises the seat section supplemental mattress 40, a hinge assembly 64 (see FIG. 5), and three different cap members (see FIG. 6). Referring to FIG. 5, the hinge assembly 64 generally comprises a deck plate 66, a first double hinge member 58, a second double hinge member 68, a first backing member 60, and a second backing member 70. In a preferred embodiment the first double hinge member 58 is preferably identical to the double hinge member 58 used in the head section 32 gap filler assembly 10, and the first backing member 60 is preferably identical to the backing member 60 used in the head section 32 gap filler assembly 10. Further, in a preferred embodiment the cap member 54 at the head end 24 of the seat section 34 gap filler assembly 10 is preferably identical to the cap member 54 at the foot end 26 of the head section 32 gap filler assembly 10, however, the other two cap members 72, 74 at the foot end 26 of the seat section 34 gap filler assembly 10 are distinct from the cap member 54 used in the head section 32 gap filler assembly 10.

In a preferred embodiment the deck plate 66 is fixedly connected at its head end 24 to the first double hinge member 58, preferably by welding, and the double hinge member 58 is fixedly connected to the first backing member 60, also preferably by welding such as spot welding. Additionally, the deck plate 66 is fixedly connected at its foot end 26 to the second double hinge member 68, preferably by welding, and the second double hinge member 68 is fixedly connected to the second backing member 70, also preferably by welding. The seat section supplemental mattress 40 is connected, such as with an adhesive, to the deck plate 66, first double hinge member 58, first backing member 60, second double hinge member 68 and second backing member 70. The deck plate 66 is subsequently connected to the supplemental deck plate 39 of the seat mattress extender assembly 44. In one embodiment the deck plate 66 has internal receivers, such as PEM® nuts, to allow the deck plate 66 to be secured, such as by bolting, to the supplemental deck plate 39. After the supplemental mattress 40 is connected to the supplemental deck plate 39 it can be manipulated between the deployed and non-deployed positions in the seat mattress extender assembly 44.

In one embodiment the first cap member 54 at the head end 24 of the seat section 34 gap filler assembly is secured to the hinge assembly 64 as shown in FIGS. 6 and 7. As with the deck plate 66, in a preferred embodiment the backing member or backing plate 60 also has internal receivers to allow the cap member 54 to be bolted to the backing plate 60. Two cap members 72 and 74, however, are provided at the foot end 26 of the seat section 34 gap filler assembly 10. The second cap member 72 is secured to the second double hinge member 68 at an area between the two hinges. Preferably, the area between the two hinges on the second double hinge member 68 has internal receivers to allow the second cap member 72 to be bolted to the second double hinge member. Finally, the third cap member 74 is secured to the second backing member 70. The second backing member 70 preferably has internal receivers to allow the third cap member 74 to be secured to the second backing member 70. Accordingly, a hinge exists between the second cap member 72 and the third cap member 74.

As shown in the side view of FIG. 2, in one embodiment the head end 24 of the seat section supplemental mattress 40 is preferably angled, or in a plane tangential to the top surface of the supplemental mattress 40. This allows the top surface at the head end 24 of the seat section supplemental mattress 40 to extend further toward the head end 24 of the bed 12, including extending beyond the side rail 46 of the seat mattress extender assembly 44. Additionally, as shown in FIG. 2, in a preferred embodiment a top portion of the supplemental mattress 40 above the cap member 54 at the head end 24 of the seat section gap filler assembly also extends toward the head end 24 of the bed 12 even further than the cap member 54 to essentially cover the top surface of the cap member 54. Additionally, in a preferred embodiment, it is understood that the head section supplemental mattresses 38 actually extends beyond the midline between the head mattress extender assembly 42 and the seat mattress extender assembly 44, and similarly the seat section supplemental mattresses 40 actually extends beyond the midline between the head mattress extender assembly 42 and the seat mattress extender assembly 44, thus causing an interference fit of both supplemental mattresses 38, 40 when both supplemental mattresses 38, 40 are in the deployed position, as shown in FIG. 2.

Figure 9:
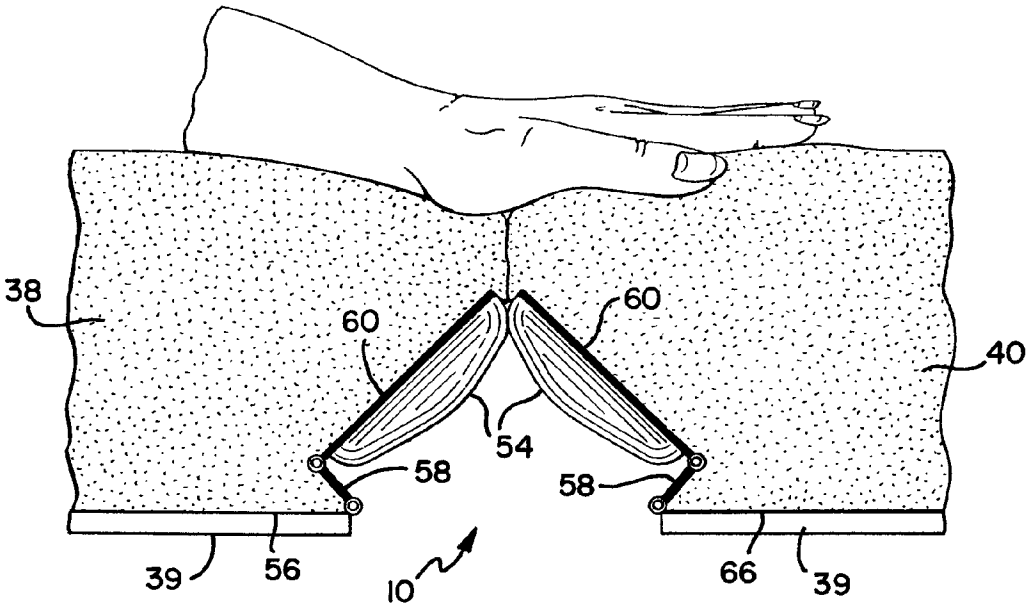
FIG. 9 is an expanded partial cutaway side view of the intersection between the gap fillers at the head section and seat section of the embodiment of FIG. 2, where a force is applied from the top at the intersection of the gap fillers.

As explained above, at the area of intersection between the head section supplemental mattress 38 and the seat section supplemental mattress 40 the foam mattresses 38, 40, both gap filler assemblies have a first double hinge member 58, a cap member 54, a top portion of the supplemental mattresses 38, 40, respectively, that extend beyond the cap member 54, and an end surface that is angled outwardly and up toward the top surface of the respective supplemental mattress 38, 40. Accordingly, as shown in FIG. 9, when a force is applied at the top surface of the supplemental mattresses 38, 40 near the joint between the head supplemental mattress 38 and the seat supplemental mattress 40, the double hinge members 58 will allow the bottom portion of each cap member 54 to bend inwardly toward the respective supplemental mattress 38, 40, and the top portion of each cap members 54 to bend outwardly away from the respective supplemental mattresses 38, 40. Thus, the extra length of the top portion of the supplemental mattress 38, 40 that extends beyond the cap member 54 providing a soft feel for the user. Further, in this manner, the top surface of the cap member 54 does not extend upwardly to provide a hard surface that would tend to be a discomfort to the user. Instead, the top surface of the cap member 54 extends laterally and is covered by the foam mattress 38, 40.

Also, in one embodiment the foot end 26 of the seat section supplemental mattress 40 is preferably angled from the top surface toward the bottom surface of the supplemental mattress 40. This allows the bottom surface at the foot end 26 of the seat section supplemental mattress 40 to extend further toward the foot end 26 of the bed 12, including extending beyond the side rail 46 of the seat mattress extender assembly 44. Additionally, in a preferred embodiment a top portion of the supplemental mattress 40 at the foot end 26 of the seat section supplemental mattress 40 has slits 76 therein to allow the foot end 26 of the supplemental mattress 40 to be more easily bent back when placing the supplemental mattress 40 in the stored position as shown in FIG. 10. Slits may also be provided in the head section 32 supplemental mattress 38.

The supplemental mattresses 38, 40 are designed to be moved from the deployed position, shown in FIGS. 1 and 2, to the non-deployed position, shown in FIG. 10, when the width of the bed 12 is desired to be narrowed. With the gap filler assemblies 10, however, the length of the supplemental mattresses 38, 40 is greater than the opening between the siderails 46 in the respective mattress extender assemblies 42, 44. Thus, the cap members 54, 72, 74 are utilized to provide a rigid member to engage the siderails 46 as the supplemental mattresses 38, 40 are rotated inwardly (see FIG. 14) to operate as a cam follower against the siderails 46 to force the supplemental mattress 38, 40 inwardly into the cavity between the siderails 46 of the mattress extender assemblies 42, 44. Additionally, as shown in FIGS. 2 and 10, because the length of the supplemental mattress 40 at the foot end 26 in the seat section 34 extends far beyond the side rail 46, a strap 78 is provided that extends from the frame of the seat mattress extender assembly 44 to the end of the supplemental mattress 40 adjacent the end cap 74. The strap 78 assists in folding the end most portion of the seat section supplemental mattress 40 inwardly, as shown in FIG. 10, when the supplemental mattress 40 is rotated into the seat mattress extender assembly 44 to more easily fold the supplemental mattress 40 into the cavity of the seat mattress extender assembly 44.

Figure 11:
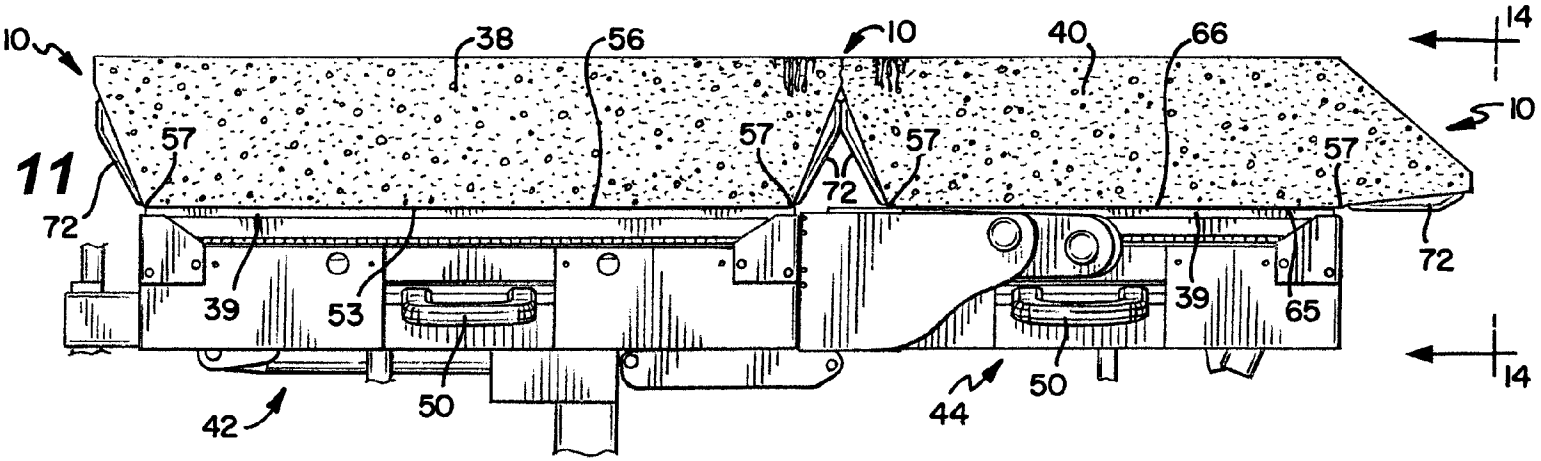
FIG. 11 is a partial side view of another embodiment of a hospital bed with mattress extenders having supplemental mattresses shown in the up or actuated/deployed position, and having gap fillers on the supplemental mattresses.
Figure 13:
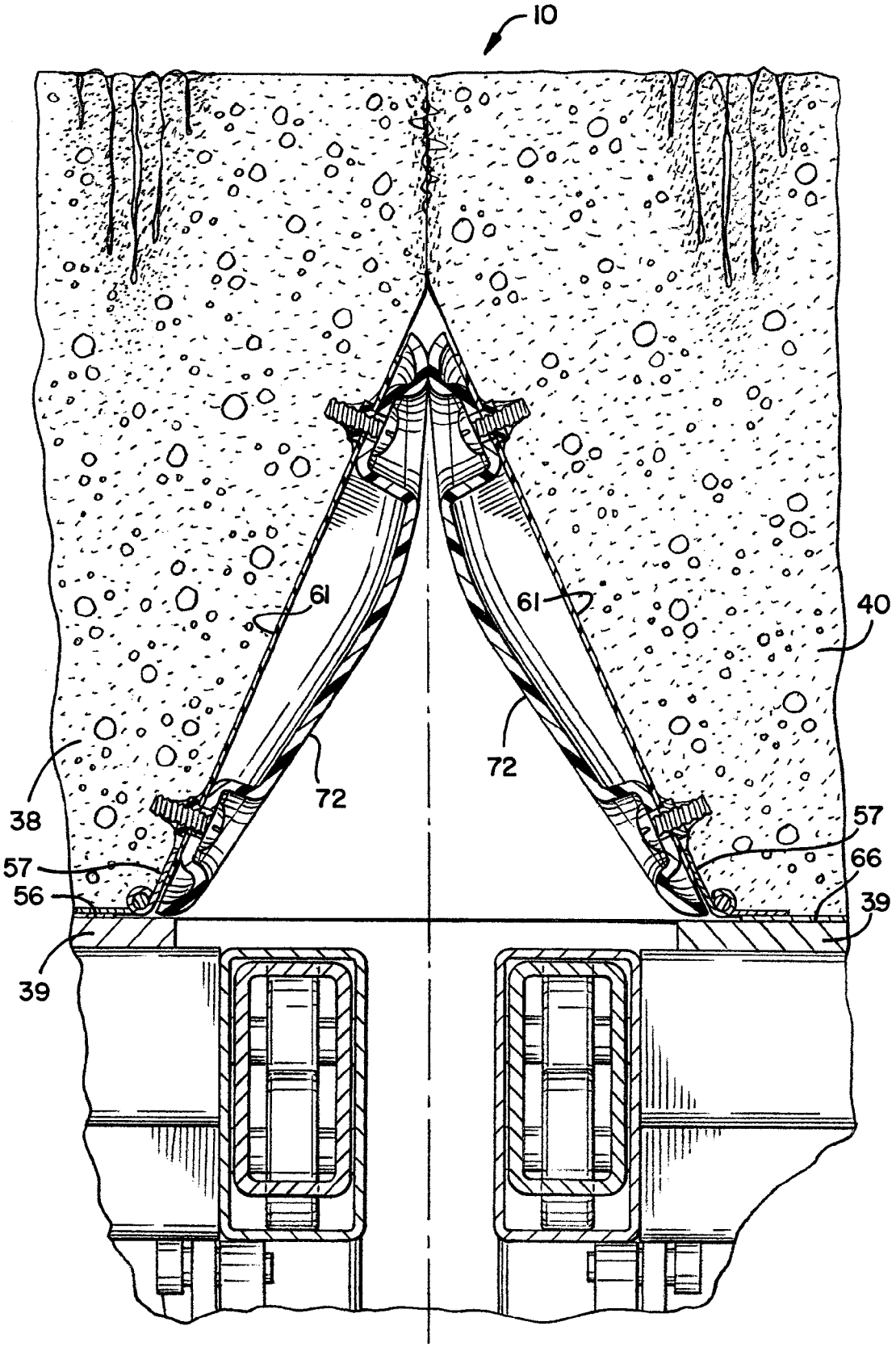
FIG. 13 is an expanded partial cutaway side view of the intersection between the gap fillers at the head section and seat section of the embodiment of FIG. 11.

Another embodiment of the gap filler assembly 10 is provided in FIGS. 11-14. In this embodiment the gap filler assembly 10 at the head section 32 also generally comprises the supplemental mattress 38, a hinge assembly 53, and a cap member 72. Referring to FIGS. 11 and 13, the hinge assembly 53 generally comprises a deck plate 56, two single hinge members 57 instead of a double hinge member 58, and two backing members 61. In a preferred embodiment one of the single hinge members 57 is fixedly connected to the head end 24 of the deck plate 56 and the other single hinge member 57 is fixedly connected to the foot end 26 of the deck plate 56. Additionally, one backing member 61 is fixedly connected to each single hinge member 57, and a cap member 72 is fixedly connected to each backing member 61. The supplemental mattress 38 is connected, such as with an adhesive, to the deck plate 56, single hinge members 57 and backing members 61. The deck plate 56 is subsequently connected to the supplemental deck plate 39 of the head mattress extender assembly 42. In one embodiment the deck plate 56 has internal receivers, such as PEM® nuts, to allow the deck plate 56 to be secured, such as by bolting, to the supplemental deck plate 39. Once the supplemental mattress 38 is connected to the supplemental deck plate 39 it can be manipulated between the deployed and non-deployed positions in the mattress extender assembly 42.

As shown in the side view of FIG. 11, in a preferred version of this embodiment the head end 24 and the foot end 26 of the head section supplemental mattress 38 is preferably angled, or in a plane tangential to the top surface of the supplemental mattress 38. This allows the top surface of the head section supplemental mattress 38 to extend further toward the head end 24 and foot end 26 of the bed 12, including extending beyond each side rail 46 of the head mattress extender assembly 42.

Accordingly, this embodiment differs from the prior embodiment in that a single hinge member 57 is utilized, rather than the double hinge member 56 of the prior embodiment. Additionally, cap members 72 are provided at both the head end 24 and the foot end 26 of the head section 32 supplemental mattress 38 of this embodiment. It is understood, however, that a head section 32 gap filler assembly 10 of this embodiment, having a single hinge member 57, instead of a double hinge member 58 may also be modified to only have a cap member 72 at the foot end 26 of the supplemental mattress 38 similar to the prior embodiment of FIG. 2. In such an embodiment, the head end 24 of the supplemental mattress 38 of this embodiment would be configured similar (i.e., generally flat) to the head end 24 of the supplemental mattress 38 of FIG. 2.

Referring again to FIGS. 11 and 13, the head end 24 portion of the seat section 34 gap filler assembly 10 of this embodiment is generally a mirror image of the foot end 26 portion of the head section 32 gap filler assembly 10 described above. However, like the prior embodiment, the foot end 26 portion of the seat section 34 gap filler assembly 10 of this embodiment is distinct from the head section 32 gap filler assembly 10 of this embodiment.

Referring to FIGS. 11 and 13, in this embodiment the gap filler assembly 10 at the seat section 34 generally comprises the seat section supplemental mattress 40, a hinge assembly 65, and two cap members 72. Like the hinge assembly 53 in the head section 32 of this embodiment, the hinge assembly 65 in the seat section 34 of this embodiment generally comprises a deck plate 66, two single hinge members 57, and two backing members 61. In a preferred version of this embodiment the first single hinge member 57 at the head end 24 of the seat section 34 gap filler assembly 10 is preferably identical to the single hinge member 57 used in the head section 32 gap filler assembly 10 of this embodiment (see FIGS. 11 and 13), and the first backing member 61 is preferably identical to the backing member 61 used in the head section 32 gap filler assembly 10 of this embodiment as well. Further, in a preferred embodiment, the cap member 72 that is connected at the head end 24 of the seat section 34 gap filler assembly 10 of this embodiment is preferably identical to the cap member 72 connected at the foot end 26 of the head section 32 gap filler assembly 10 of this embodiment. Additionally, the cap member 72 at the foot end 26 of the seat section 34 gap filler assembly 10 of this embodiment may be the same as the cap member 72 at the head end 24 of the seat section 34 gap filler assembly 10 of this embodiment as shown in FIGS. 11 and 13. Accordingly, this embodiment differs from the prior embodiment at least in that a single hinge member 57 is utilized at each end, rather than the double hinge member 56 of the prior embodiment.

In a preferred embodiment the deck plate 66 is fixedly connected at its head end 24 to the first single hinge member 57, and at its foot end 26 to the second single hinge member 57, preferably by welding. Additionally, a backing member 61 is also connected to each single hinge member 57 to allow the cap member 72 to be fixed thereto as is explained herein. The seat section supplemental mattress 40 is connected, such as with an adhesive, to the deck plate 66, both single hinge members 57, and both backing members 61. The backing members at the head end and foot end of this gap filler assembly may, or may not be identical, generally depending on the configuration of the supplemental mattress at the head end and foot end of this section. The deck plate 66 is subsequently connected to the supplemental deck plate 39 of the seat mattress extender assembly 44. After the supplemental mattress 40 is connected to the supplemental deck plate 39 it can be manipulated between the deployed and non-deployed positions in the seat mattress extender assembly 44.

As shown in the side view of FIG. 11, in one embodiment the head end 24 of the seat section supplemental mattress 40 of this embodiment is preferably angled, or in a plane tangential to the top surface of the supplemental mattress 40. This allows the top surface at the head end of the seat section supplemental mattress 40 to extend further toward the head end 24 of the bed 12, including extending beyond the side rail 46 of the seat mattress extender assembly 44. As in the prior embodiment, in a preferred embodiment the head section supplemental mattress 38 extends beyond the midline between the head mattress extender assembly 42 and the seat mattress extender assembly 44, and similarly the seat section supplemental mattress 40 extends beyond the midline between the head mattress extender assembly 42 and the seat mattress extender assembly 44, thus causing an interference fit of both supplemental mattresses 38, 40 when both supplemental mattresses 38, 40 are in the deployed position, as shown in FIG. 11.

Also as shown in the side view of FIG. 11, in one embodiment the foot end 26 of the seat section supplemental mattress 40 is preferably angled from the top surface toward the bottom surface of the supplemental mattress 40. This allows the bottom surface at the foot end 26 of the seat section supplemental mattress 40 to extend further toward the foot end 26 of the bed 12, including extending beyond the side rail 46 of the seat mattress extender assembly 44.

The supplemental mattresses 38, 40 of this embodiment are designed to be moved from the deployed position, shown in FIG. 11, to the non-deployed position, shown in FIG. 12, when the width of the bed 12 is desired to be narrowed. As in the prior embodiment, the length of the supplemental mattresses 38, 40 is greater than the opening between the siderails 46 in the respective mattress extender assemblies 42, 44. Thus, the cap members 72 are utilized to provide a rigid member to engage the siderails 46 as the supplemental mattresses 38, 40 are rotated inwardly (see FIG. 14) to operate as a cam follower against the siderails 46 to force the supplemental mattress 38, 40 inwardly into the cavity between the siderails 46 of the mattress extender assemblies 42, 44.

Figure 16:
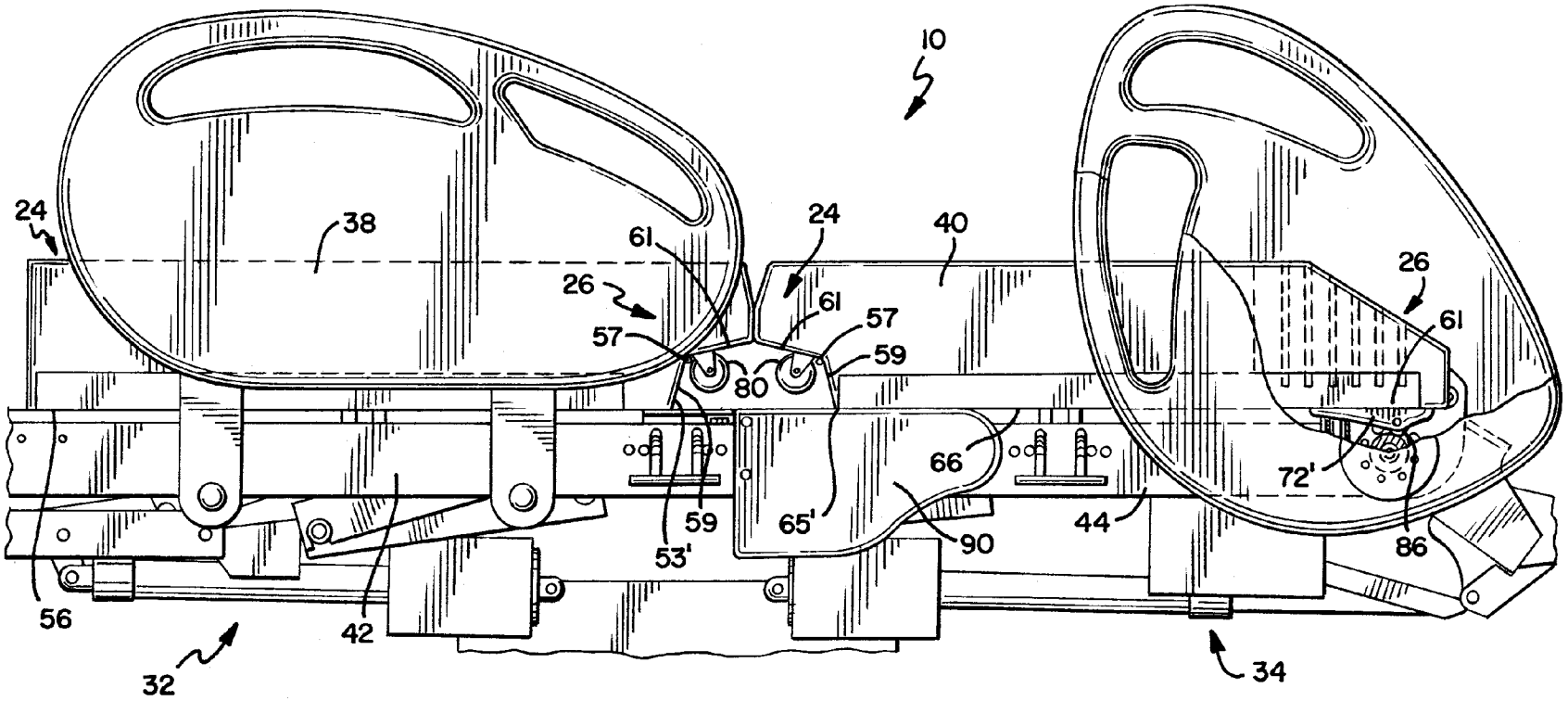
FIG. 16 is a partial side view of another embodiment of a hospital bed with mattress extenders having supplemental mattresses shown in the up or actuated/deployed position, and having gap fillers on the supplemental mattresses.
Figure 17:
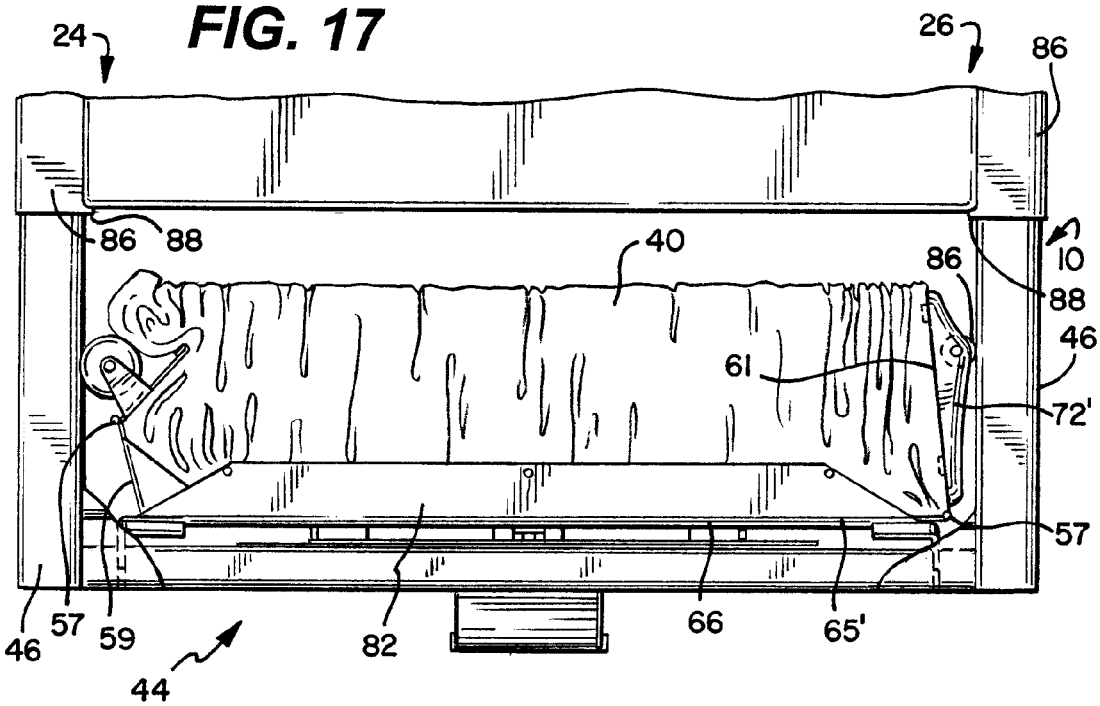
FIG. 17 is a partial top view of the embodiment of a hospital bed of FIG. 16 having mattress extenders with supplemental mattresses having gap fillers, and wherein the supplemental mattress are provided in the closed or non-deployed position (only the seat section is shown); and, FIG. 18 is a perspective end view of the seat end of the supplemental mattress at the head section for the gap filler assembly of FIG. 16.
Figure 18:
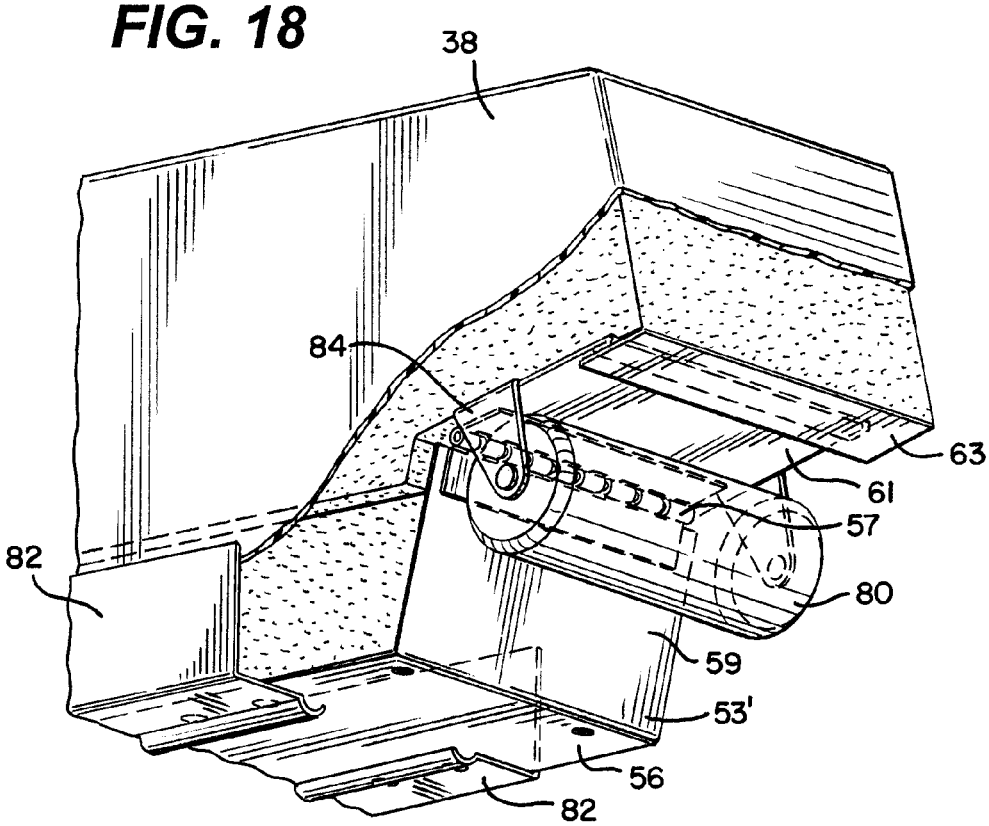

Another embodiment of the gap filler assembly 10 is provided in FIGS. 16-18. In this embodiment the gap filler assembly 10 at the head section 32 also generally comprises the supplemental mattress 38 and a hinge assembly 53'. But, rather than employing a cap member at the end of the supplemental mattress 38 to assist in folding the portion of the supplemental mattress 38 that extends beyond the side rail 46 of the head mattress extender assembly 42, in this embodiment a roller 80 is employed. The cap member and roller members can be described as slider members or sliders. As is explained herein, the roller 80 also assists in providing a smooth transition as the head mattress extender assembly 42 is manipulated, preferably in a sliding manner, from the second expanded or out position, as shown in FIG. 17, to a first retracted or in position wherein the mattress extender assembly 42 is pushed inward and under the main deck of the bed 12. Additionally, a gap shield assembly 90 is shown in FIG. 16.

As shown in the side view of FIG. 16, in a preferred version of this embodiment, which is similar in certain respects and dissimilar in other respects to the embodiment of FIG. 2, the head end 24 of the head section supplemental mattress 38 is generally flat, or in a plane perpendicular to the top surface of the supplemental mattress 38 and generally does not extend beyond the side rail 46 of the head mattress extender assembly. Conversely, and the foot end 26 of the head section supplemental mattress 38 is preferably angled, or in a plane tangential to the top surface of the supplemental mattress 38 and also extends beyond the side rail 46 of the head mattress extender assembly. As explained herein, the angled portion assists in allowing the top surface of the head section supplemental mattress 38 to extend further toward the foot end 26 of the bed 12, including extending beyond each side rail 46 of the head mattress extender assembly 42.

Referring again to FIGS. 16-18, at the head section the hinge assembly 53' generally comprises a deck plate 56, a single hinge member 57 similar to the embodiment of FIG. 11 (instead of the double hinge member utilized in the embodiment of FIGS. 9 and 10) and a backing member 61. As shown in FIG. 18, in one embodiment the deck plate 56 may have an angled component 59 thereto to angle the end portion of the deck plate 56 up and away from the planar surface of the deck plate 56. In one embodiment of the head deck plate 56 the angled component 59 is only provided at the foot end 26, where the hinge member 57 and roller 80 are provided, because the head end 24 of the supplemental mattress 38 in this embodiment is flat as explained above to fit directly within the side rail 46 of the head mattress extender assembly 42. The angled component 59 may be a bent portion of the deck plate 56, or it may be welded or otherwise connected to the flat portion of the deck 56 during manufacture thereof.

In a preferred embodiment the single hinge member 57 is fixedly connected to the foot end 26 of the angled component 59 of the deck plate 56 because, as explained above, the head end 24 is generally flat. The hinge member 57 in this embodiment allows roller 80 to rotate toward the main body of the supplemental mattress 38 as shown in FIG. 17 to assist in squeezing the supplemental mattress 38 when the supplemental mattress 38 is moved to the stowed position of FIG. 17. It is understood, however, that rollers 80 may be employed at both the head end 24 and the foot end 26 of the deck plate 56 in an alternate embodiment not shown. In such an embodiment a hinge member 57 and backing plate 61 would also be employed at the head end 24 of the deck plate 56. The backing plate 61 is connected to the hinge member 57 to provide a rigid member for pushing in the supplemental. mattress when the supplemental mattress is stowed. This structure and function of the backing plate 61 is similar at both the head and seat sections. The backing plate 61 at the head section, however, may have any additional plate 63 to provide additional support for the supplemental mattress.

As best shown in FIGS. 17 and 18, the roller 80 generally provides two functions. First, the roller 80 assists in folding the portion of the supplemental mattress 38 that extends beyond the side rail 46 of the head mattress extender assembly 42 into the area between the siderails 46 during stowing of the supplemental mattress 38. This is because the roller 80 is positioned such that a radius at the end of the roller 80 engages an interior surface of the side rail 46 of the head mattress extender assembly 42, thereby forcing the roller 80 and supplemental mattress 38 inside the head mattress extender assembly 42 as the supplemental mattress 38 is stowed. The roller 80 also assists in providing a smooth transition of the head mattress extender assembly 42 as the head mattress extender assembly 42 is manipulated, preferably in a sliding manner, from the second expanded or out position, as shown in FIG. 17, to a first retracted or in position wherein the mattress extender assembly 42 is pushed inward and under the main deck of the bed 12. In one embodiment the roller 80 is connected to the backing plate 61 of the hinge assembly 53'. A pair of roller support members 84 are used to support the roller 80 on the backing plate 61. The roller 80 must have sufficient diameter to provide a smooth rolling transition when the mattress extender assembly 42 is pushed inward and under the main deck of the bed 12. For example, in one embodiment the side rails 46 of the mattress extender assembly 42 extend within receiving tubes 86 of the bed 12. Thus, a lip 88 is provide at the end of the receiving tubes 86. The larger diameter of the roller 80 assists in traversing the lip 88 in a smooth manner, and the combination of the roller 80 and backing plate 61 assist in maintaining the supplemental mattress 38 away from both the inner wall of the siderails and the lip 88 of the receiving tubes 86 to prevent the supplemental mattress 38 from dragging or getting caught on the lip 88. The diameter of the roller 80 is approximately between 0.5 inches and 1.75 inches, and is preferably approximately 1.0 inches in diameter.

In this embodiment the supplemental mattress 38 is connected, such as with an adhesive, to the deck plate 56, single hinge member 57 and backing member 61. The deck plate 56 is subsequently connected to the supplemental deck plate 39 of the head mattress extender assembly 42. In one embodiment the deck plate 56 has internal receivers, such as PEM® nuts, to allow the deck plate 56 to be secured, such as by bolting, to the supplemental deck plate 39. Alternately, the deck plate 56 may be connected to another receiving member to be connected to the supplemental deck plate 39. Once the supplemental mattress 38 is connected to the supplemental deck plate 39 it can be manipulated between the deployed and non-deployed positions in the mattress extender assembly 42. As shown in FIG. 18, an angled plate 82 may be employed at either or both sides of the supplemental mattress 38 to provide additional support for the supplemental mattress 38 and deck plate 56.

As best shown in FIG. 16, the head end 24 portion of the seat section 34 gap filler assembly 10 of this embodiment is generally a mirror image of the foot end 26 portion of the head section 32 gap filler assembly 10 of this embodiment described above. However, like the prior embodiments, the foot end 26 portion of the seat section 34 gap filler assembly 10 of this embodiment is distinct from the head section 32 gap filler assembly 10 of this embodiment.

Referring to FIGS. 16 and 17, in this embodiment the gap filler assembly 10 at the seat section 34 generally comprises the seat section supplemental mattress 40, a hinge assembly 65', a roller member 80 and a modified cap member 72'. The hinge assembly 65' in the seat section 34 of this embodiment generally comprises a deck plate 66, two single hinge members 57, and two backing members 61.

In a preferred version of this embodiment the deck plate 66 at the head end 24 of the seat section 34 gap filler assembly 10 is identical to the foot end 26 of the deck plate 56 used in the head section 32 gap filler assembly 10. Accordingly, the head end 24 of the deck plate 66 for the seat section 34 has an angled component 59 to angle the end portion of the deck plate 66 up and away from the planar surface of the deck plate 66. The angled component 59 may be a bent portion of the deck plate 66, or it may be welded or otherwise connected to the flat portion of the deck 66 during manufacture thereof. The backing member 61 at the head end 24 of the seat section 34 is connected to the deck plate 66 with a single hinge member 57 at the angled component 59 of the seat section deck plate 66. The hinge member 57 in this embodiment allows roller 80 at the head end 24 of the seat section 34 to rotate toward the main body of the supplemental mattress 40 as shown in FIG. 17 to assist in squeezing the supplemental mattress 40 when the supplemental mattress 40 is moved to the stowed position of FIG. 17. The first single hinge member 57 at the head end 24 of the seat section 34 gap filler assembly 10 is preferably identical to the single hinge member 57 used at the foot end 26 in the head section 32 gap filler assembly 10 of this embodiment (see FIG. 16), and the first backing member 61 at the head end 24 of the seat section 34 gap filler assembly 10 is preferably identical to the backing member 61 used at the foot end 26 of the head section 32 gap filler assembly 10 of this embodiment as well. Further, in a preferred embodiment, the roller 80 and roller support members 84 that are connected to the backing member 61 at the head end 24 of the seat section 34 gap filler assembly 10 of this embodiment is preferably identical to the roller 80 and roller support members 84 connected at the foot end 26 of the head section 32 gap filler assembly 10 of this embodiment.

The modified cap member 72' at the foot end 26 of the seat section 34 gap filler assembly 10 of this embodiment is similar to the cap member 72 at the foot end 26 of the seat section 34 gap filler assembly 10 of the embodiment of FIG. 11, however as shown in FIGS. 16 and 17, the modified cap member 72' has a roller 86 associated therewith. Further, this embodiment, like the embodiment of FIG. 11, differs from the first embodiment described herein in FIG. 2 at least in that a single hinge member 57 is utilized at the foot end 26 of the seat section 34 of the gap filler assembly 10, rather than the double hinge member 56 of the first embodiment.

Referring to the modified cap member 72', a roller is added to the plastic cap to assist in providing a smooth transition as the seat mattress extender assembly 44 is manipulated, preferably in a sliding manner, from the second expanded or out position, as shown in FIG. 17, to a first retracted or in position wherein the seat mattress extender assembly 44 is pushed inward and under the main deck of the bed 12. Preferably, the modified cap member 72' with its roller 86 is connected to the backing plate 61 of the hinge assembly 65'. The roller 86 preferably is rotatably connected to the modified cap member 72'. The roller 86 in combination with the geometry of the plastic cap portion of the modified cap member 72' provides a sufficient diameter to provide a smooth transition when the seat section mattress extender assembly 44 is pushed inward and under the main deck of the bed 12. As explained above, in one embodiment the side rails 46 of the mattress extender assembly 44 extend within receiving tubes 86 of the bed 12, and a lip 88 is created at the end of the receiving tubes 86. The diameter of the roller 86 in combination with the geometry of the plastic cap portion of the modified cap member 72' assists in traversing the lip 88 in a smooth manner, and the combination of the modified cap member 72' and backing plate 61 assist in maintaining the seat supplemental mattress 40 away from both the inner wall of the siderails and the lip 88 of the receiving tubes 86 to prevent the seat supplemental mattress 40 from dragging or getting caught on the lip 88. Because the geometry of the plastic cap portion of the modified cap member 72' assists in the overall configuration, the diameter of the roller 86 need not be as large as the diameter of the roller 80, and is approximately between 0.375 inches and 1.0 inches.

As explained above, in a preferred embodiment the deck plate 66 is fixedly connected at its head end 24 to the first single hinge member 57 (preferably at the angled component 59 as explained above), and at its foot end 26 to the second single hinge member 57, preferably by welding. Additionally, a backing member 61 is also connected to each single hinge member 57 to allow the roller 80 at the head end 24 and the modified cap member 72' at the foot end 26 to be fixed thereto as is explained herein. The seat section supplemental mattress 40 is connected, such as with an adhesive, to the deck plate 66, both single hinge members 57, and both backing members 61. The backing members at the head end and foot end of this embodiment of the gap filler assembly are typically not identical, based on the configuration of the supplemental mattress at the head end and foot end of this embodiment. The deck plate 66 is subsequently connected to the supplemental deck plate 39 of the seat mattress extender assembly 44. After the supplemental mattress 40 is connected to the supplemental deck plate 39 it can be manipulated between the deployed and non-deployed positions in the seat mattress extender assembly 44.

As shown in the side view of FIG. 16, in one embodiment a portion of the head end 24 of the seat section supplemental mattress 40 of this embodiment is preferably angled, or in a plane tangential to the top surface of the supplemental mattress 40. This allows the top surface at the head end of the seat section supplemental mattress 40 to extend further toward the head end 24 of the bed 12, including extending beyond the side rail 46 of the seat mattress extender assembly 44. As in the prior embodiments, in a preferred embodiment the head section supplemental mattress 38 extends beyond the midline between the head mattress extender assembly 42 and the seat mattress extender assembly 44, and similarly the seat section supplemental mattress 40 extends beyond the midline between the head mattress extender assembly 42 and the seat mattress extender assembly 44, thus causing an interference fit of both supplemental mattresses 38, 40 when both supplemental mattresses 38, 40 are in the deployed position, as shown in FIG. 16.

Also as shown in the side view of FIG. 16, in one embodiment the foot end 26 of the seat section supplemental mattress 40 is preferably angled from the top surface toward the bottom surface of the supplemental mattress 40. This allows the bottom surface at the foot end 26 of the seat section supplemental mattress 40 to extend further toward the foot end 26 of the bed 12, including extending beyond the side rail 46 of the seat mattress extender assembly 44.

The supplemental mattresses 38, 40 of this embodiment are designed to be moved from the deployed position, shown in FIG. 16, to the non-deployed position, shown in FIG. 17, when the width of the bed 12 is desired to be narrowed. As in the prior embodiments, the length of the supplemental mattresses 38, 40 is greater than the opening between the siderails 46 in the respective mattress extender assemblies 42, 44. Thus, the rollers 80 and modified cap member 72' are utilized to provide a rigid member to engage the siderails 46 as the supplemental mattresses 38, 40 are rotated inwardly (see FIG. 14) to operate as a cam follower against the siderails 46 to force the supplemental mattress 38, 40 inwardly into the cavity between the siderails 46 of the mattress extender assemblies 42, 44, and to provide a smooth transition as the mattress extender assemblies 42, 44 are slid into their stowed position.

While different beds are referenced herein, such as a standard bed, a chair bed, an expanding width bed, etc., it is understood that any feature of the gap filler assembly 10 disclosed herein may be utilized with any type of patient support mechanism, and reference to one type of bed respecting a particular feature does not preclude incorporation of that feature into any other type of bed.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. Additionally, the terms "first," "second," "third," and "fourth" as used herein are intended for illustrative purposes only and do not limit the embodiments in any way. Further, the term "plurality" as used herein indicates any number greater than one, either disjunctively or conjunctively, as necessary, up to an infinite number.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein. Accordingly, while the specific embodiments have been illustrated and described, numerous modifications come to mind without significantly departing from the spirit of the invention and the scope of protection is only limited by the scope of the accompanying Claims.

What is claimed is:

1. A gap filler assembly for filling a gap between adjacent sections of a bed adjacent a main mattress of the bed, the gap filler assembly comprising:

a first supplemental mattress connected and proximate to a first section of the bed adjacent a first longitudinal side of the main mattress, the first supplemental mattress having a patient support surface generally planar with a patient support surface of the main mattress so as to increase an overall width of the patient support surface of the bed beyond a width defined by the main mattress;

second supplemental mattress connected and proximate to a second section of the bed adjacent the first longitudinal side of the main mattress, the second supplemental mattress having a patient support surface generally planar with the patient support surface of the main mattress so as to increase the overall width of the patient support surface of the bed beyond the width defined by the main mattress;

the first and second supplemental mattresses being proximate each other with a gap formed therebetween, each of the first and second supplemental mattresses having an angled extension at one end thereof that extends into the gap, the angled extensions being in direct contact so as to form an interference fit with one another.

2. The gap filler assembly of claim 1, wherein the first supplemental mattress extends beyond a midline between the first section of the bed and the adjacent second section of the bed.

3. The gap filler assembly of claim 1, wherein the second supplemental mattress extends beyond a midline between the first section of the bed and the adjacent second section of the bed.

4. The gap filler assembly of claim 1, wherein the first supplemental mattress is connected to a hinge assembly, the hinge assembly comprising a deck plate, a hinge connected to the deck plate, a backing member connected to the hinge and opposing the deck plate, and a slider connected to the backing member, and wherein the first supplemental mattress has an angled surface on a bottom portion thereof adjacent the slider.

5. The gap filler assembly of claim 4, wherein the slider member is a roller.

6. The gap filler assembly of claim 4, wherein the slider member is a roller supported by a cap member.

7. The gap filler assembly of claim 1, wherein at least one of the first supplemental mattress and the second supplemental mattress has an extension at a second end thereof.

8. The gap filler assembly of claim 1, wherein the first supplemental mattress has an angled surface on a bottom portion thereof toward a top surface of the first supplemental mattress.

9. The gap filler assembly of claim 8, wherein a slider is connected to the first supplemental mattress adjacent the angled surface at the bottom portion of the first supplemental mattress.

10. The gap filler assembly of claim 1, wherein a hinged slider is connected to a bottom portion of the extension of the first supplemental mattress.

* * * * *